US006634201B2

(12) United States Patent
Hosonuma

(10) Patent No.: US 6,634,201 B2
(45) Date of Patent: Oct. 21, 2003

(54) METHOD AND APPARATUS FOR DRAWING ELONGATED STOCK CONTINUOUSLY

(75) Inventor: Tetsuo Hosonuma, Shiki (JP)

(73) Assignee: Nihon Shinkan Co., Ltd. (JP)

( * ) Notice: Subject to any disclaimer, the term of this patent is extended or adjusted under 35 U.S.C. 154(b) by 1 day.

(21) Appl. No.: 09/987,572

(22) Filed: Nov. 15, 2001

(65) Prior Publication Data

US 2002/0092334 A1 Jul. 18, 2002

(30) Foreign Application Priority Data

Jan. 18, 2001 (JP) ..... 2001-010343
Jul. 27, 2001 (JP) ..... 2001-227555

(51) Int. Cl.[7] ..... B21C 1/00
(52) U.S. Cl. ..... 72/277; 72/285; 72/283
(58) Field of Search ..... 72/277, 283, 285, 72/281, 290, 291; 279/119

(56) References Cited

U.S. PATENT DOCUMENTS 168,975 A * 10/1875 Farmer ..... 72/277
2,610,860 A * 9/1952 Coan ..... 279/119
3,172,529 A * 3/1965 Brauer ..... 72/277
5,535,612 A 7/1996 Vijayakar ..... 72/43
5,771,727 A 6/1998 Stinnertz et al. ..... 72/21.4
6,079,248 A 6/2000 Ballin ..... 72/283

* cited by examiner

*Primary Examiner*—Allen Ostrager
*Assistant Examiner*—John S Goetz
(74) *Attorney, Agent, or Firm*—Lorusso, Loud & Kelly

(57) ABSTRACT

A method and apparatus for continuously drawing an elongated stock permit plural types of drawings within a narrower area, by a series of automated steps and permit easy adjustment of the distance between a front end position of a plug and an outlet position of a die. A holding member with plural types of dies is mounted at a central position relative to reciprocation of an elongated stock. When the elongated stock is to be moved from one side to the opposite side of the die holding member, it is passed through an elongated stock passage, not through the dies, while when the elongated stock is to be moved from the opposite side to the one side of the die holding member, it is passed through one of the plural dies. The elongated stock is reciprocated plural times between the one side and the opposite side of the die holding member and the die holding member is moved at each passage of the elongated stock through a die to change the type of die.

12 Claims, 15 Drawing Sheets

METHOD AND APPARATUS FOR DRAWING ELONGATED STOCK CONTINUOUSLY

CROSS-REFERENCE TO RELATED APPLICATION

This application claims priority of Japanese Application No. 2001-227555 filed Jul. 27, 2001 and Japanese Application No. 2001-010343 filed Jan. 18, 2001.

BACKGROUND OF THE INVENTION

1. Field of the Invention

The present invention relates to a method and apparatus for drawing an elongated stock continuously through different dies.

2. The Prior Art

Heretofore, there has been known an elongated stock drawing apparatus for causing the elongated stock to pass through a die for reduction to a predetermined diameter. Such a conventional drawing apparatus is shown in FIGS. 13 and 14, which are a front view and a side view, respectively, of the drawing apparatus. The elongated stock drawing apparatus includes, as components shown in FIG. 13, a base 50, dies 52 fixed onto the base 50, a first moving means 56 having a chuck 54 and adapted to reciprocate horizontally on the base 50, a swing means 62 with a rod 60 pivotally attached thereto, the rod 60 having a plug 58 at a front end thereof, a hydraulic cylinder 64 for moving the swing means 62 horizontally, the hydraulic cylinder 64 being fixed onto the base 50, and a holder 68 for holding an elongated stock 66 at a predetermined position, the holder 68 being provided above the base 50. The elongated stock 66 is in the shape of a cylinder, one end of which is formed with a flat portion 70 (flatwise crushed portion) as shown in FIG. 15.

The elongated stock drawing apparatus includes, as components shown in FIG. 14, and in addition to the above components, a lower receptacle 72 disposed at a position lower than the base 50 on one side of the base, an upper receptacle 74 disposed at a position higher than the base 50 on another side of the base, and a transfer means 76 for transferring the elongated stock 66 from the lower receptacle 72 to the upper receptacle 74.

The method for drawing the elongated stock members 66 with use of the elongated stock drawing apparatus will now be described. As shown in FIGS. 13, 14, and 15, a predetermined number (three in FIG. 13) of the elongated stock members 66 are put on the holder 68 which is in an inclined state. In this case, the elongated stock members 66 are put on the holder 68 in such a manner that the flat portion 70 thereof and a cylindrical opening thereof are positioned up and down, respectively. The swing means 62 has rods 60 in a number corresponding to the number of the elongated stock members 66. The swing means 62 adjusts the angle of each rod 60 so that the rods are aligned with the elongated stock members 66 on the holder 68. That is, the position of the plug 58 at the front end of each rod 60 is lifted higher than its horizontal position.

Next, a drive means (not shown) provided at an upper end of the holder 68 is driven to move an elongated stock member 66 downward with the cylindrical opening facing down and to receive, through its open end, the plug 58 on the front end of the rod. Thereafter, as shown in FIGS. 13 and 15, the swing means 62 causes the rod 60 to swing into a horizontal position so that a central axis of the rod 60 and the center of the die 52 are aligned with each other. Then, the hydraulic cylinder 64 is actuated to move the elongated stock member 66 toward the die 52 until the flat portion 70 of the elongated stock passes through the interior space of the die 52 and projects from the opposite side. At the same time, the first moving means 56 equipped with the chuck 54 moves toward the die 52 and the chuck 54 chucks the flat portion 70 of the elongated stock 66. In this chucked state of the elongated stock 66, the first moving means 56 moves to the side opposite the die 52. As a result, the elongated stock member 66 passes through the die 52 and is thereby drawn into a predetermined diameter. The elongated stock member 66 thus drawn is received into the lower receptacle 72 as shown in FIG. 14.

For drawing the elongated stock member 66 into a desired diameter, the stock 66 is subjected to a first drawing to a diameter a little larger than the desired diameter and is then subjected to a second drawing to the desired diameter which is relatively smaller. As the case may be, the elongated stock 66 is passed a total of three times or more through dies 52 of different diameters.

Since the elongated stock 66 is long and the lower and upper receptacles 72, 74 are provided to the side of the elongated stock drawing apparatus, the area occupied by the drawing apparatus is large. For this reason, all of the working steps from the beginning to end are carried out using a single elongated stock drawing apparatus. For obtaining an elongated stock 66 of a desired diameter with use of a single elongated stock drawing apparatus, it is necessary that the die 52 and plug 58 used in the first drawing be replaced with smaller ones at the time of shift to the second drawing. This replacement work requires much time and a large number of working steps. The working steps before and after the die and plug replacement have already been automated, but the attainment of complete automation throughout requires automation of this replacing work.

In drawing, the distance X (FIG. 15) between a front-end position of the plug 58 inserted into the die 52 and an outlet position of the die 52 is very important in attaining high drawing accuracy and it is necessary to adjust the distance X with every replacement of the plug 34. The distance X is visually checked. For checking the distance X with this apparatus, a worker is required to position his or her head in a region (region Y in FIG. 15) on the side opposite the rod 60 in the die 52 and to check the distance X visually. However, the holder 68 is an obstacle to positioning of the worker's head in region Y and thus it is difficult to visually check and adjust the distance X.

SUMMARY OF THE INVENTION

The present invention has been accomplished in view of the above and it is an object of the invention to provide a continuous drawing method and apparatus for an elongated stock member which permit plural types of drawings to be carried out, in an area narrower than that of the prior art, by a series of automated steps and which permit easy adjustment of the distance between the front-end position of the plug and the outlet position of the die.

For achieving the above-mentioned object, the continuous drawing method according to the present invention comprises providing a movable die holding member, with plural different types of dies being mounted at a central position relative to reciprocation of the elongated stock members, and with a large opening allowing the stock members to bypass the dies when moved from one side to the opposite side of the die holding member. The die holding member can also be positioned to allow the elongated stock members to be drawn through one set of the plural dies when the elongated stock is to be moved from one side to the other of the die holding member, causing the elongated stock to reciprocate plural times between the one side and the opposite side with the die holding member therebetween, and moving the die holding member at every passage of the elongated stock through one of the die sets to change the die type from one to another.

For achieving the foregoing object, the continuous drawing apparatus according to the present invention comprises a base, a die holding member movable with respect to the base and having plural different types of dies attached thereto, a chuck means for chucking the elongated stock, a first moving means for moving the chuck means toward the die holding member; the first moving means being provided on one side of the die holding member, a rod to be inserted into the elongated stock provided on the side opposite the first moving means with respect to the die holding member, and a second moving means for moving the rod toward the first moving means, whereby when the elongated stock member is moved to the rod side by the first moving means and is fitted on the rod, the elongated stock is passed through a space in the die holding member bypassing the dies. Then, when the elongated stock fitted on the rod is moved toward the first moving means by the second moving means, the die holding member is moved so that the elongated stock is drawn through one of the dies.

DETAILED DESCRIPTION OF A PREFERRED EMBODIMENT

Figure 1:
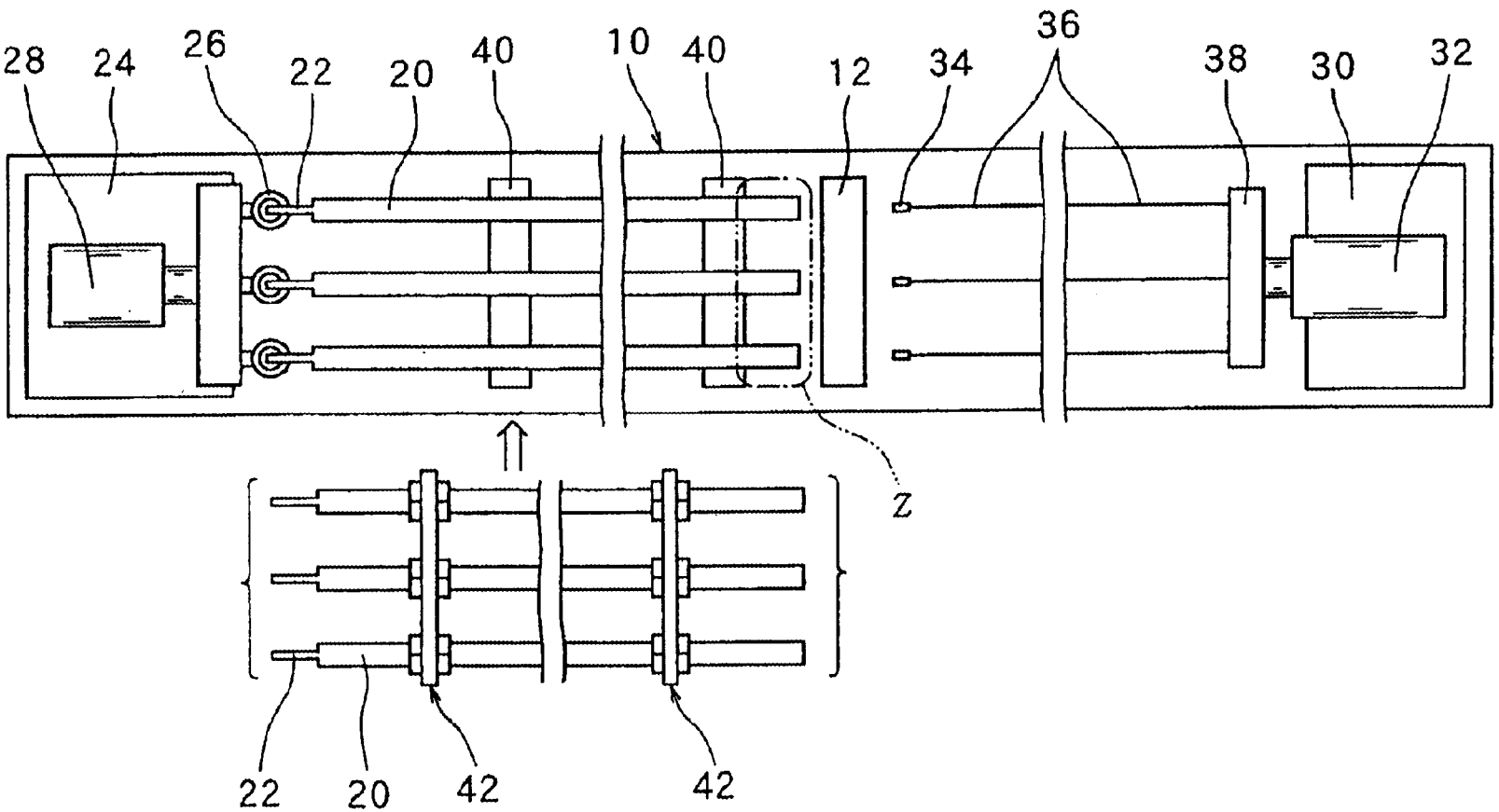
FIG. 1 is a plan view of an elongated stock drawing apparatus according to a first embodiment of the present invention.
Figure 2:
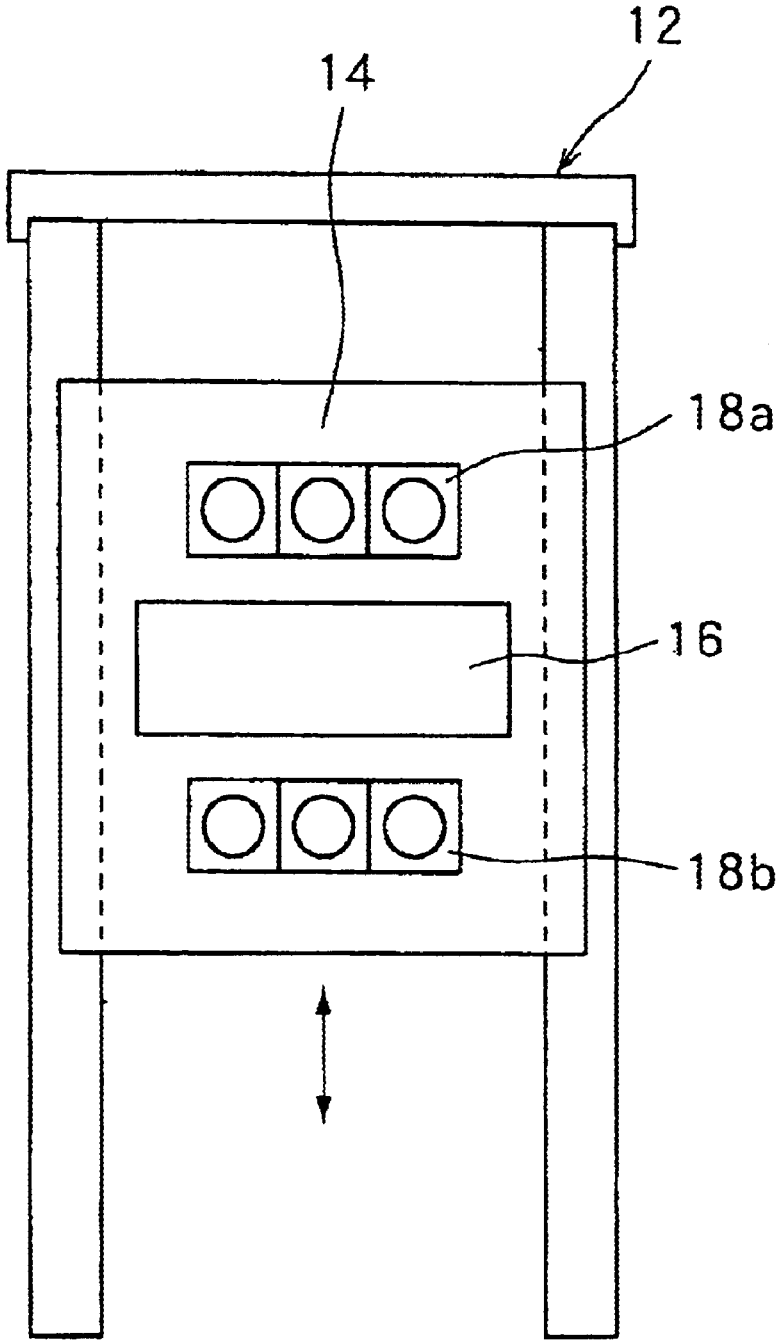
FIG. 2 is a front view of a die holding member employable in the invention.

The present invention will now be described with reference to the drawings. FIG. 1 is a plan view of a continuous elongated stock drawing apparatus embodying the present invention. A support post 12 shown in FIG. 2 is fixed near the center of the longitudinal dimension of a base 10 and a die holding member 14, which is movable vertically, is mounted on the support post 12. An elongated stock passage 16 of a large size is formed in the die holding member 14 and two different types of dies 18*a* and 18*b* are mounted in the die holding member. In this continuous elongated stock drawing apparatus, for example three elongated stock members 20 are to be drawn, so three dies 18*a* and three dies 18*b* are secured to the holding member 14 with each set in a horizontal array. The elongated stock passage 16 formed in the holding member 14 is of a size which permits free passage therethrough of the three elongated stock members 20. The elongated stocks 20 are each in the shape of a cylinder and a flat portion 22 (flatwise crushed portion) is formed at one end of the cylinder.

Figure 3:
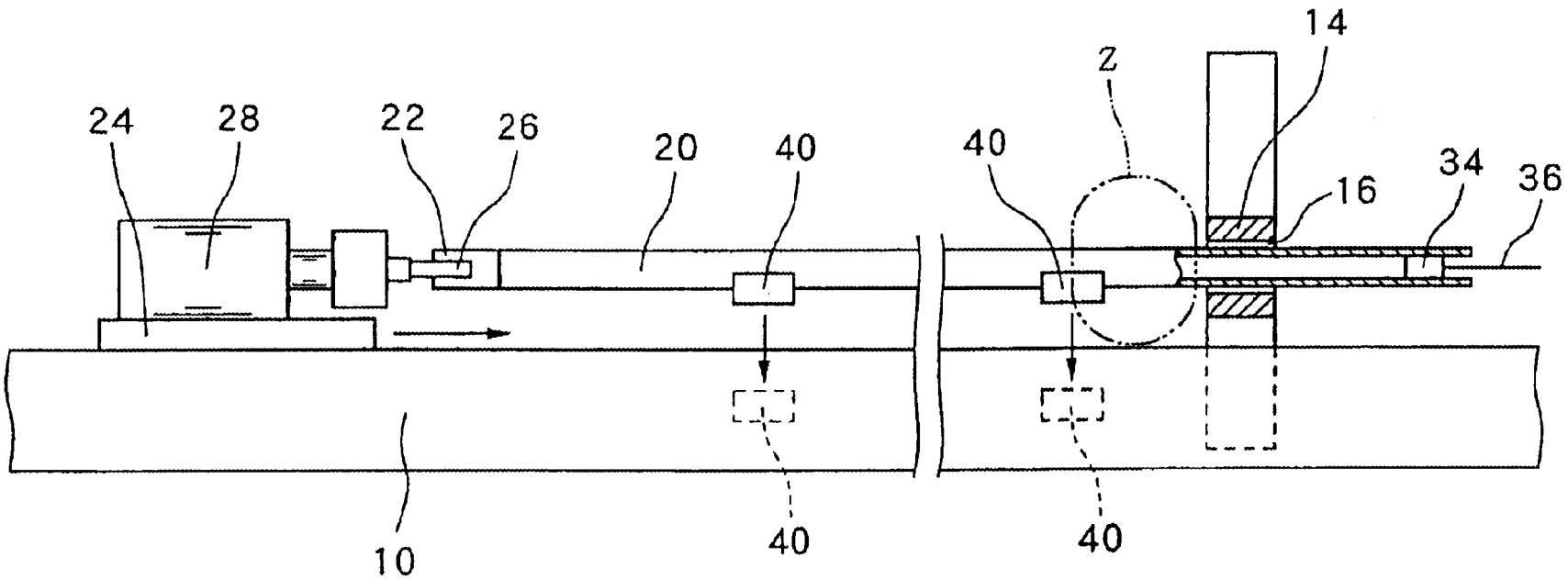
FIG. 3 is a partial front view of FIG. 1.

As shown in FIGS. 1 and 3, on one side of the support post 12 (the die holding member 14), a reciprocating member 24 capable of horizontal reciprocating motion is provided on an upper surface of the base 10. Onto the reciprocating member 24 is fixed a pusher means 28 having chucks 26 for chucking the elongated stock members. The pusher means 28 causes the chucks 26 to be moved horizontally.

Figure 4:
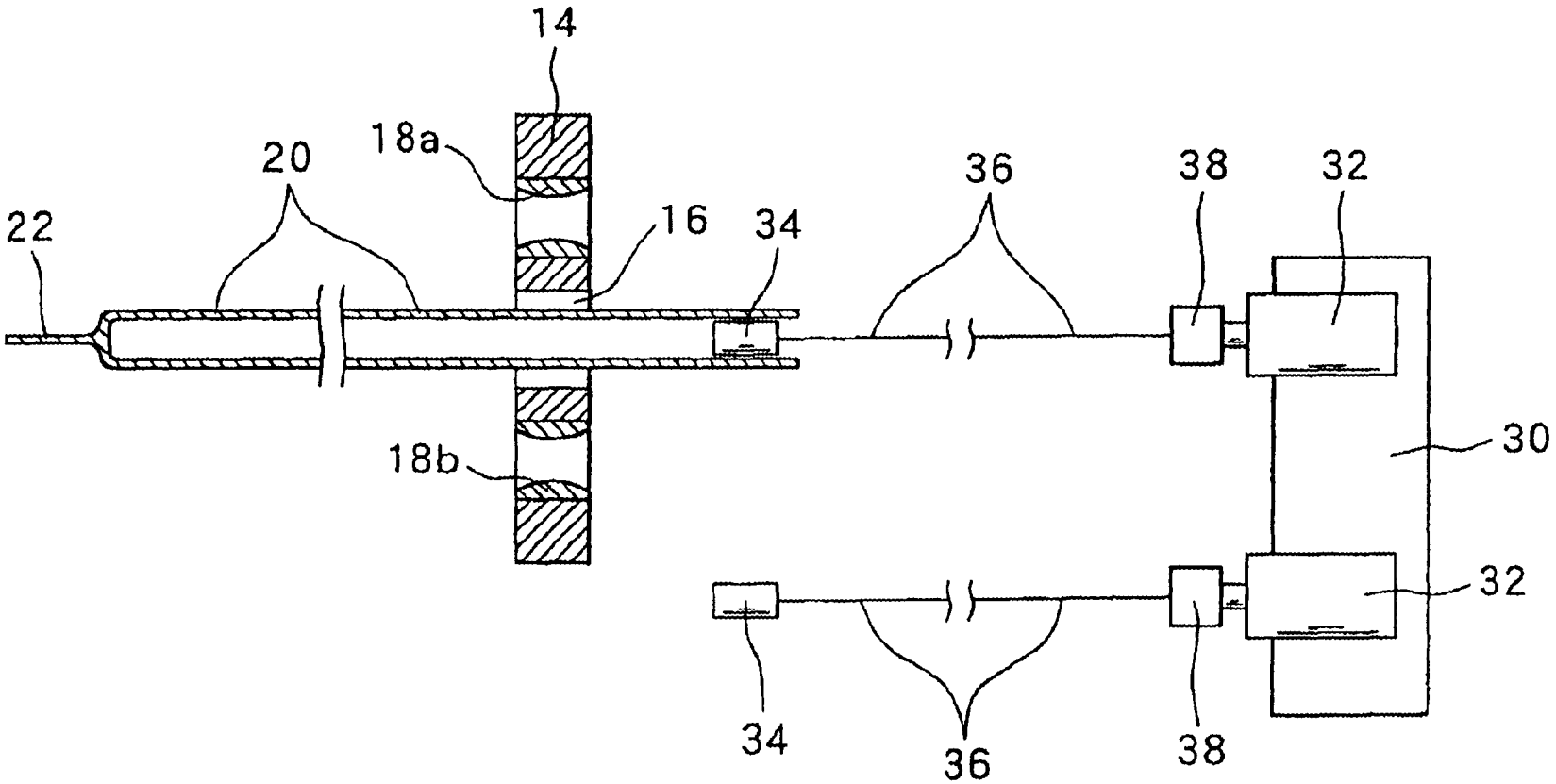
FIG. 4 is a diagram of a principal portion of the embodiment of FIG. 1.

As shown in FIGS. 1 and 4, on the opposite side of the support post 12, a vertically movable member 30 is provided at a position close to an end of the base 10. A total of two second moving means 32 such as hydraulic cylinders are fixed to the vertically movable member 30 and are vertically spaced from each other. To each of the second moving means 32 is fixed a support member 38 to which are mounted three rods 36 with plugs 34 fixed to respective front ends. The three rods 36 are held horizontally so as to move axially and horizontally upon operation of the second moving means 32. For example, the size of each plug 34 attached to the upper second moving means 32 is set to correspond to the size of dies 18*a*, while the size of each plug 34 attached to the lower second moving means 32 is set to correspond to the size of dies 18*b*.

As shown in FIGS. 1 and 3, on the reciprocating member 24 side of the support post 12 (the die holding member 14), a plurality of holding members 40 for holding the three elongated stock members 30 are provided, together with means for vertically moving same. The holding members 40 are mounted so that when they have moved upward (when they assume their solid line positions in FIG. 3), central axes of the elongated stock members on the holding members 40 are in alignment with central axes of the rods 36, while when they have moved downward (when they assume their dotted line positions in FIG. 3), the reciprocating member 24 can move freely on the base 10 without obstruction by the holding members 40.

Figure 5:
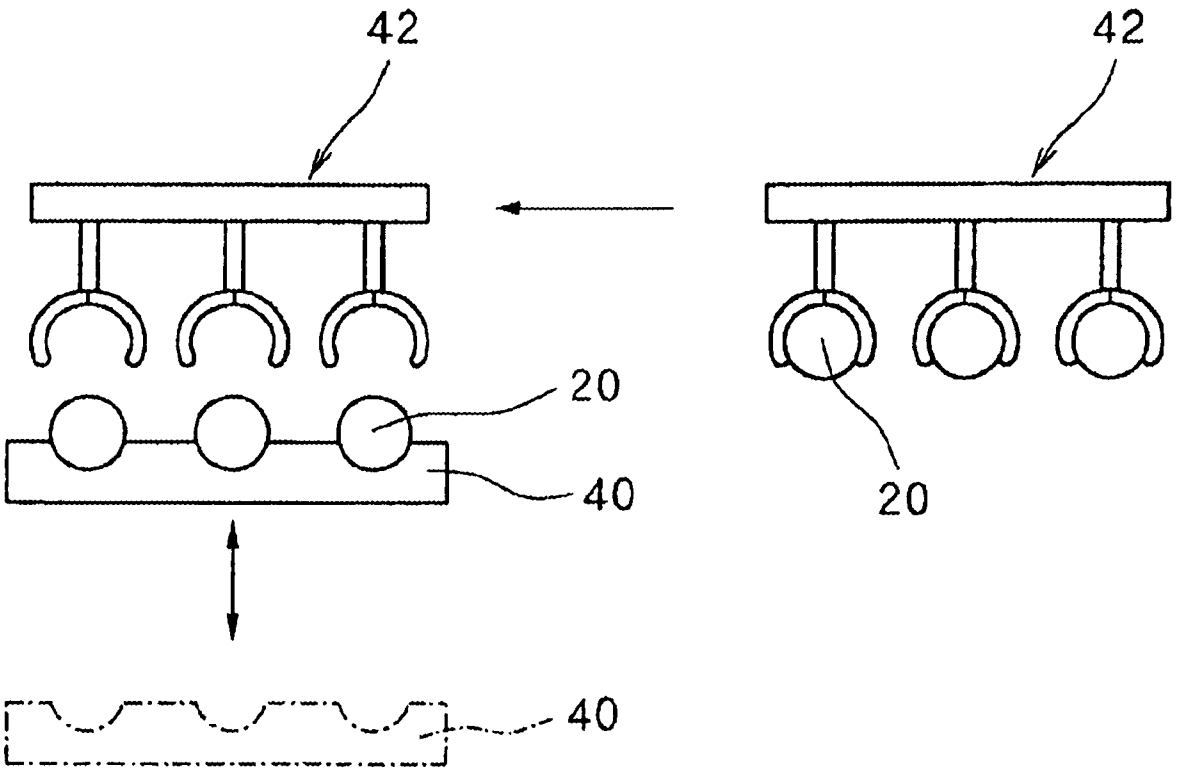
FIG. 5 is a schematic diagram explaining the operation of a holding/moving means employable in the invention.

As shown in FIGS. 1 and 5, a holding/moving means 42 is provided for holding and moving three elongated stock members between a position above the base 10 and a position above and sideways of the base. The holding/moving means 42 functions to hold three elongated stocks 20 above and sideways of the base 10, to then move up to above the base, and to put the three elongated stocks 20 onto the holding members 40.

The procedure for drawing of the elongated stocks 20 using this continuous drawing apparatus will now be described. First, the die holding member 14 is moved to an appropriate position so that elongated stocks 20 pass through the elongated stock passage 16. Then, the vertically movable member 30 is moved vertically so that rods 36 provided with plugs 34 for the first stage of drawing are aligned with the stock passage 16. The plural holding members 40 are maintained in their uppermost positions (shown by solid lines in FIG. 3).

With the holding members 40 thus shifted upward, as shown in FIG. 5, the three elongated stocks 20 are held by the holding/moving means 42 above and sideways of the base 10 and then the holding/moving means 42 is moved to above the base 10, where the three elongated stocks 20 are put onto the holding members 40. With the three elongated stocks 20 thus resting on the holding members 40 (FIG. 1), the central axes of the elongated stocks 20 are in alignment with the elongated stock passage 16 formed in the die holding member 14 and are aligned with the central axes of the rods 36 provided with plugs 34 for the first stage of drawing. After the three elongated stocks 20 have been put on the holding members 40, the chucks 26 chuck the respective flat portions 22 of the elongated stocks 20.

Thereafter, the reciprocating member 24 moves toward the die holding member 14 (rightwards in FIG. 1). With this movement of the reciprocating member 24, the free front ends of the elongated stocks 20 enter the elongated stock passage 16 in the die holding member 14 and then the front-end openings of the elongated stocks 20 are respectively fitted on the plugs 34 fixed to the front ends of the rods 36 (FIGS. 3 and 4). In this state with the front-end openings of the elongated stocks 20 fitted on the plugs 34, the elongated stocks are held by both chucks 26 and plugs 34. Thereafter, the holding members 40 move downward, thereby permitting a further movement of the reciprocating member 24 toward the die holding member 14.

Figure 6:
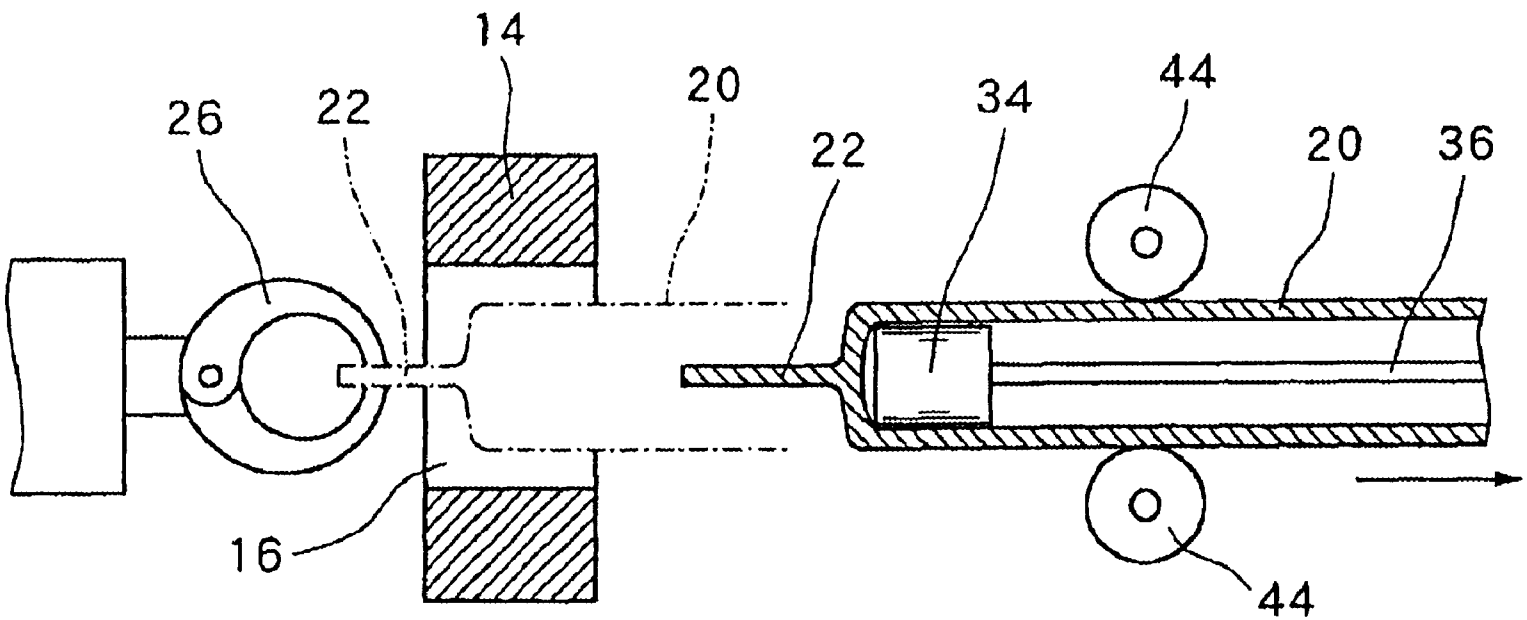
FIG. 6 is a diagram illustrating passage of an elongated stock member through the die holding member.

The reciprocating member 24 moves toward the die holding member 14 to a maximum extent and thereafter the elongated stocks 20 are further moved toward the rods 36 (for fine adjustment of distance) by the pusher means 28. With the elongated stocks 20 thus moved to a maximum extent by the reciprocating member 24 and the pusher means 28, as shown in FIG. 6, the flat portions 22 of the elongated stocks 20 are within elongated stock passing space 16 (dot-dash line positions of each elongated stock 20 and its flat portion 22) and the flat portion 22 of each elongated stock 20 has not completely cleared the space 16. In order to pass the flat portion 22 of each elongated stock 20 completely through the elongated stock passage 16, as shown in FIG. 6, rollers 44 are disposed near each plug 34, thereby causing the flat portion 22 of each elongated stock 20 to move toward the plug 34 (rightwards in FIG. 6). With the flat portion 22 of each elongated stock 20 thus moved to the plug 34 side (the solid line position of the elongated stock 20 in FIG. 6), the elongated stock 20 passes through the elongated stock passage 16 completely, whereby it becomes possible for the die holding member 14 to freely move vertically.

Figure 7:
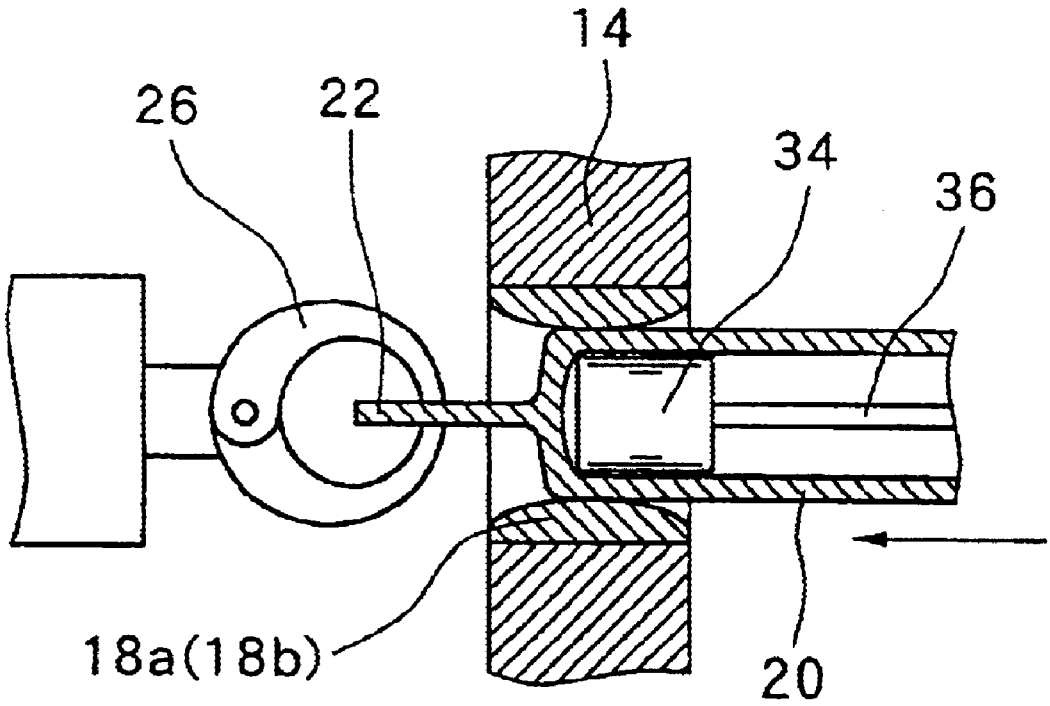
FIG. 7 is a diagram illustrating the manner in which an elongated stock member is drawn through a die.

Subsequently, the die holding member 14 is moved to move the dies 18*a* (used in the first stage of drawing) up to the position aligned with the axes of the rods 36. Then, the second moving means 32 is operated, causing the rods 36 with the elongated stocks 20 fitted thereon to advance toward the dies 18*a*. When the rods 36 with the elongated stocks 20 fitted thereon have advanced a maximum extent toward the dies 18*a*, as shown in FIG. 7, the front ends of the flat portions 22 of the elongated stocks 20 pass the dies 18*a* and project from the side opposite the rods 36. The chucks 26 chuck the front ends of the flat portions having passed through the dies 18*a* and then the reciprocating member 24 is moved away from the dies 18*a*, whereby the firststage of drawing for the elongated stocks with the dies 18*a* is performed. Before end portions of the elongated stocks 20 pass through the dies 18*a*, the holding members 40 are moved up to hold the elongated stocks. Further, the second moving means 32 is operated to move the rods 36 toward the side opposite the dies 18*a* to return the rods to a predetermined position. The first-stage of drawing is now over.

Next, for the second-stage of drawing, the die holding member 14 is moved to position the elongated stock passage 16 on a level with the dies 18*a*. At the same time, the vertically movable member 30 is moved upward so that the central axes of the rods 36 provided with the plugs 34 for the second-stage of drawing become aligned with the central axes of the elongated stocks 20. Thereafter, the reciprocating member 24 is moved toward the die holding member 14, allowing the elongated stocks 20 to pass into the elongated stock passage 16 and be fitted on the rods 36 (plugs 34). At this time, the holding members 40 are moved down and the elongated stocks 20 are fitted on the rods 36 to the maximum extent by both the reciprocating member 24 and the pusher means 28. Subsequently, the flat portions 22 of the elongated stocks 20 are moved toward the plugs 34 by the rollers 44 serving as retracting means, allowing the elongated stocks 20 to pass completely through the elongated stock passage 16.

Next, the die holding member 14 is moved to position the dies 18*b* at the level where the elongated stock passage 16 had been. Thereafter, the second moving means 32 is operated to move the elongated stocks 20 toward the dies 18*b*, allowing the front ends of the flat portions 22 of the elongated stocks to pass through the dies 18*b*. Then, the flat portions 22, having passed through the dies 18*b*, are chucked by the chucks 26 and the reciprocating member 24 is moved away from the dies 18*b*. In this way the second stage of drawing for the elongated stocks is performed by the dies 18*b*. Before end portions of the elongated stocks 20 pass through the dies 18*b*, the holding members 40 are raised to hold the elongated stocks. Now, the second stage of drawing is over. Thereafter, the elongated stocks 20 are moved to the next process by a conveying means (not shown).

In the present invention, the elongated stock passage 16, for free passage therethrough of the elongated stocks 20, is formed in the die holding member 14 and two types of dies 18*a* and 18*b* are provided. For carrying out the first- or the second-stage of drawing, the elongated stocks 20 are passed through the elongated stock passage 16 which is an open hole and are moved to a preparatory position for drawing, then the first-stage dies 18*a* or the second-stage dies 18*b* are placed at the position at which the elongated stock passage 16 had been, and the elongated stocks 20 are drawn through the dies 18*a* or 18*b*. Thus, in case of plural drawings and when not drawing, at a point in time when the elongated stocks 20 are to be moved from one side to the other side of the die holding member 14, the elongated stocks 20 are passed through the elongated stock passage 16 and are moved to the preparatory position for drawing, thus permitting plural types of drawings to be carried out continuously with use of a single drawing apparatus. Thus, the work of replacing the plugs 34 and dies 18*a* and 18*b* for each type of drawing as in the prior art is no longer needed and a series of automated steps can be performed. Besides, it is possible to omit steps previously needed and thereby shorten the time required for the drawing work.

Since with the apparatus of the present invention plural stages of drawing for the elongated stocks 20 are carried out while reciprocating the stocks, the area of the apparatus can be made narrower than in the prior art wherein the elongated stock members 20 are moved sideways each time drawing is performed.

Before placing the elongated stock members 20 on the apparatus, there is nothing present in an area (area Z in FIGS. 1 and 3) on the side of the dies 18*a* and 18*b* opposite the rods 36. Therefore, a worker can put his or her head in the area Z and visually determine the distance X between the front end of each of the plugs 34 inserted into the dies 18*a*, 18*b* and the outlets of the dies. Thus, the worker can adjust the distance while observing the distance X. Consequently, it is possible to draw the elongated stock members 20 with a higher accuracy.

Although in the above description two types of dies 18*a* and 18*b* are provided in the die holding member 14, three or more types of dies may be provided according to the number of drawing stages.

Although in the above description the elongated stock passage (opening) 16 is formed in the die holding member 14, only plural dies may be provided in the die holding member 14 without forming the elongated stock passage 16 therein. In this case, by moving the die holding member 14 upward or downward, the elongated stock members 20 are allowed to pass around the exterior of the dies.

When the reciprocating member 24 has moved toward the die holding member 14 to its maximum extent, the flat portions 22 of the elongated stock members 20 have not completely passed through the elongated stock passage 16 of the die holding member 14, as indicated with a dot-dash line in FIG. 6. Therefore, as shown in FIG. 6, the rollers 44 disposed near the plugs 34 are brought into contact with the elongated stock members 20 and are rotated, thereby causing the elongated stocks 20 to pass through the opening 16.

In case of using the rollers 44, however, since oil is adhered to the surfaces of the elongated stock members 20, there is the fear that slippage may occur due to the oil at the time of movement of the rollers in contact with the elongated stock members. Moreover, since the elongated stocks 20 differ in diameter depending on the type thereof, it is necessary to adjust the spacing between the rollers 44. Further, when the rollers 44 come into contact with the surface of each elongated stock member 20, the surface of a portion to be used as a pipe product may be damaged.

Figure 8:
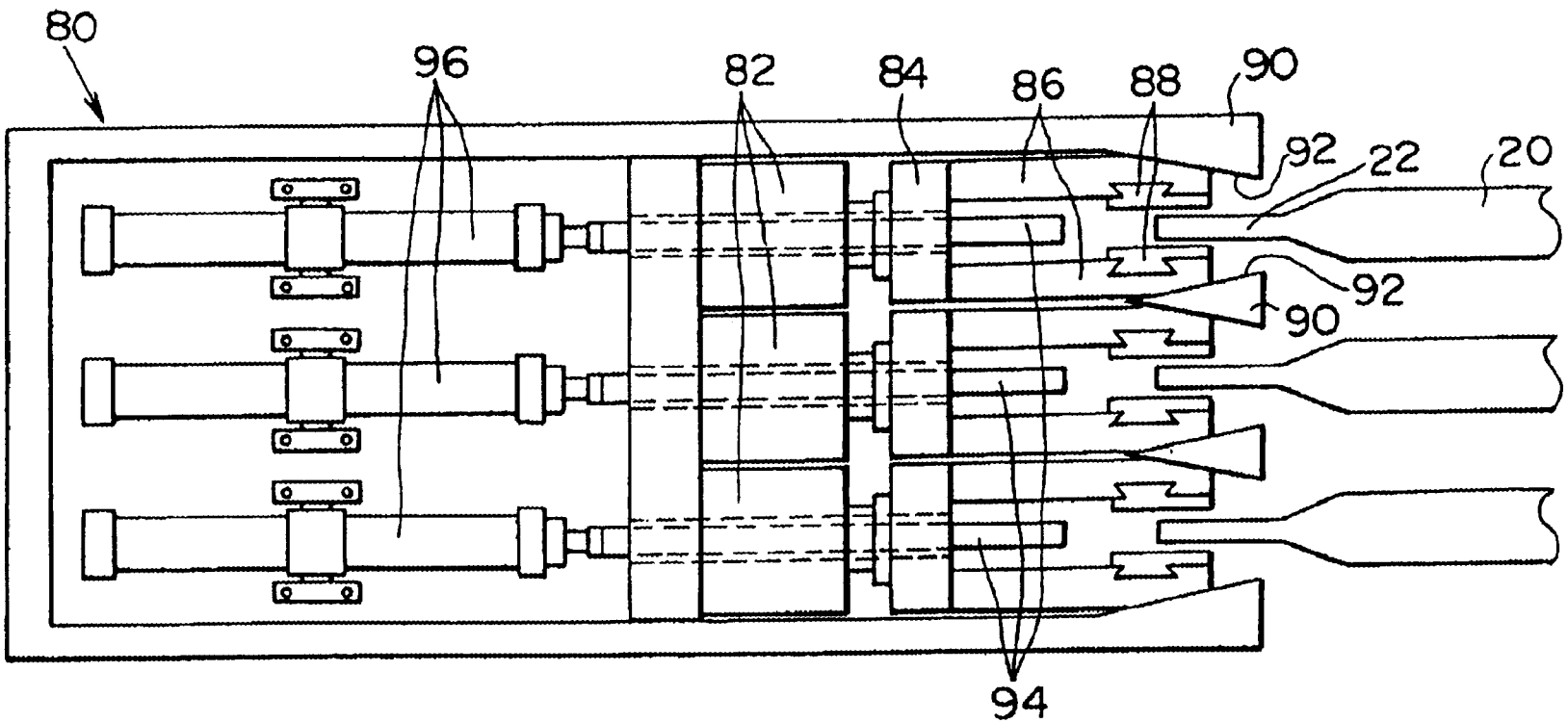
FIG. 8 is a plan view showing another embodiment of a chuck means and pushing/moving means employable in the invention.

FIGS. 8 to 11 illustrate another embodiment which permits the elongated stocks 20 to pass completely through the elongated passage (opening) 16 in the die holding member 14 without using the rollers 44. FIG. 8 illustrates chuck means and pushing/moving means for fixing and holding the flat portions 22 of the elongated stock members 20. The chuck means and pressing/moving means shown in FIG. 8 are used in place of the chucks 26 and the presser means 28. A reciprocating member 80 capable of horizontal reciprocating motion is provided on an upper surface of the base 10 shown in FIG. 1 (omitted in FIG. 8). Plural chucking cylinders 82 are fixed to the reciprocating member 80. An actuating member 84 is attached to a front end of each chucking cylinder 82 and a pair of spaced arms 86 extend from the actuating member 84. Chucks 88 are respectively fixed to front ends of the paired arms 86. A chuck means is composed of a chucking cylinder 82, an actuating member 84, a pair of arms 86, and a pair of chucks 88.

Each chucking cylinder 82 and each actuating member 84 are cylindrical and have hollow centers. The paired arms 86 attached to the actuating member 84 are supported so that they can move toward and away from each other. The reciprocating member 80 is formed with wall portions 90. At one end the wall portions 90 are tapered (tapered surfaces 92) for contact with front-end outer surfaces of the arms 86. By the action of the front ends of the paired arms 86 contacting the tapered surfaces, when the chucking cylinder 82 operates and the actuating members 84 and the pair of arms 86 move away from the chucking cylinder 82 (rightward in FIG. 8), the pair of arms 86 move toward each other (close), while when the actuating member 84 and the pair of arms 86 move toward the chucking cylinder 82 (leftward in FIG. 8), the pair of arms 86 move away from each other (open).

Figure 9:
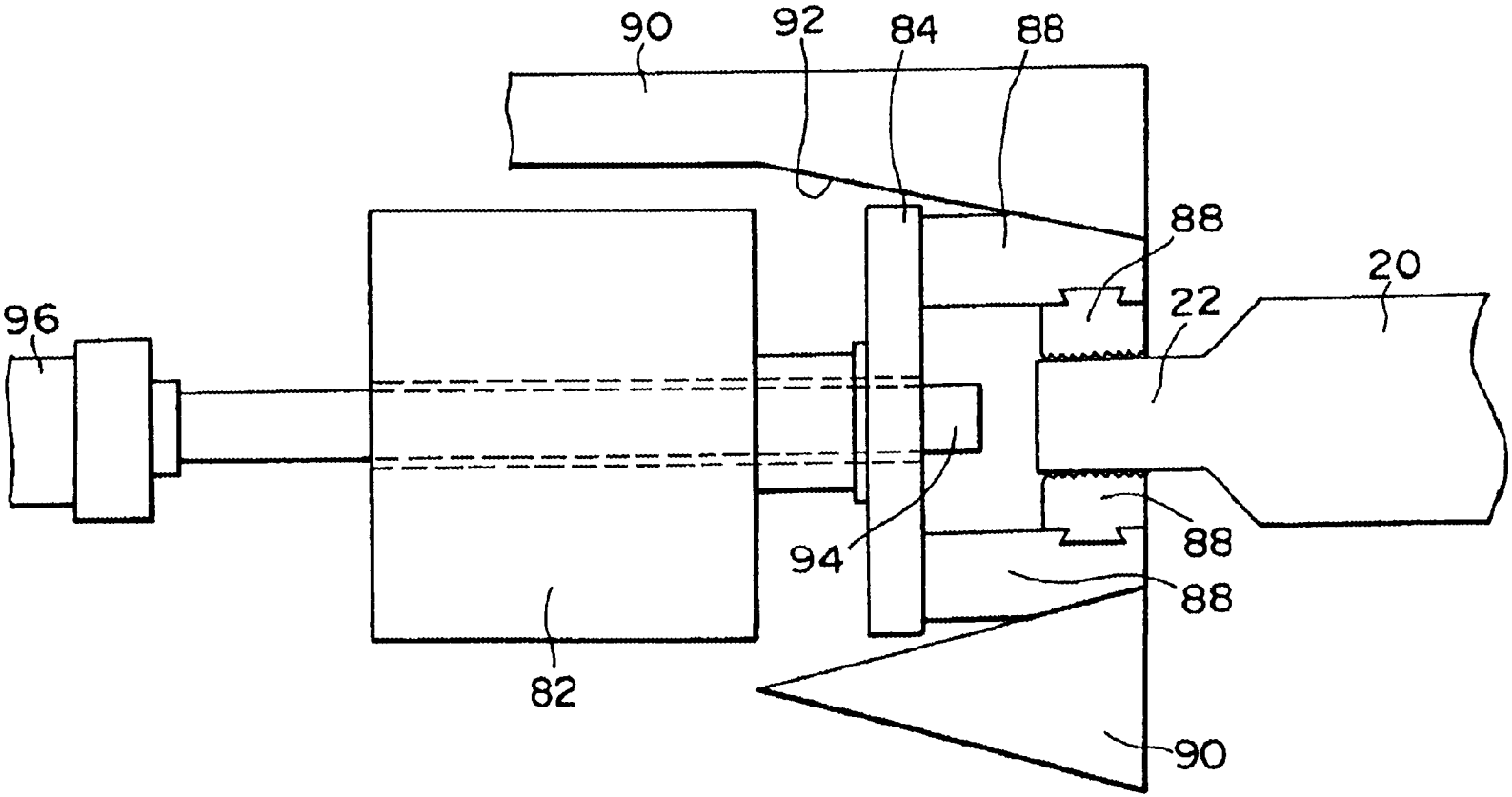
FIG. 9 is a partial plan view showing a flat portion of the elongated stock member fixed with the chuck means shown in FIG. 8.

When the actuating member 84 for the chucking cylinder 82 is positioned closest to the chucking cylinder 82 (FIG. 8), the pair of chucks 88 do not contact the flat portion 22 of the associated elongated stock 20. Thereafter, when the chucking cylinder 82 operates and the actuating member 84 and the pair of arms 86 move away from the chucking cylinder 82, the pair of arms 86 move toward each other and the pair of chucks 88 attached to the arm 86 come into contact with the flat portion 22 of the elongated stock 20, which flat portion is fixed and held by the pair of chucks 88 (FIG. 9).

As shown in FIG. 8, pushing/moving cylinders (pushing/moving means) 96 having actuating rods 94 are respectively fixed to the reciprocating member 24. Each pushing/moving cylinder 96 is disposed so that the actuating rod 94 thereof passes through cylindrical interior spaces of the chucking cylinder 82 and the actuating member 84. That is, a central axis of the actuating rod 94, a central axis of the cylindrical space of the chucking cylinder 82, and a central axis of the cylindrical space of the actuating member 84 are aligned with one another. By thus allowing the actuating rod of the pushing/moving cylinder 96 to pass through the interior of the chuck means (by aligning the central axis of the pressing/moving means with that of the chuck means) it is possible to reduce the size of the entire apparatus.

While the pushing/moving cylinder 96 is not in operation, a front end of the actuating rod 94 is positioned between the pair of arms 86 and is not in contact with the flat portion 22 of the associated elongated stock 20. After the flat portion 22 of the elongated stock 20 is chucked and fixed by the pair of chucks 88 (the state shown in FIG. 9), the reciprocating member 80 is moved toward the die holding member 14 in FIG. 1. By thus moving the reciprocating member 80 toward the die holding member 14 in FIG. 1, each elongated stock 20 passes through the elongated stock passage 16 formed in the die holding member 14 and its front-end opening is fitted on the plug 34 fixed to the front end of the rod 36.

When the reciprocating member 80 has moved to a maximum extent toward the die holding member 14 in FIG. 1, the greater part of the elongated stock 20 has passed through the elongated stock 16 in the die holding member 14, but the chucks 88 and the pair of arms 92 cannot pass through the space 16. In other words, the flat portion 22 end of the elongated stock 20 has not passed completely through the space 16 (see FIG. 10).

Figure 10:
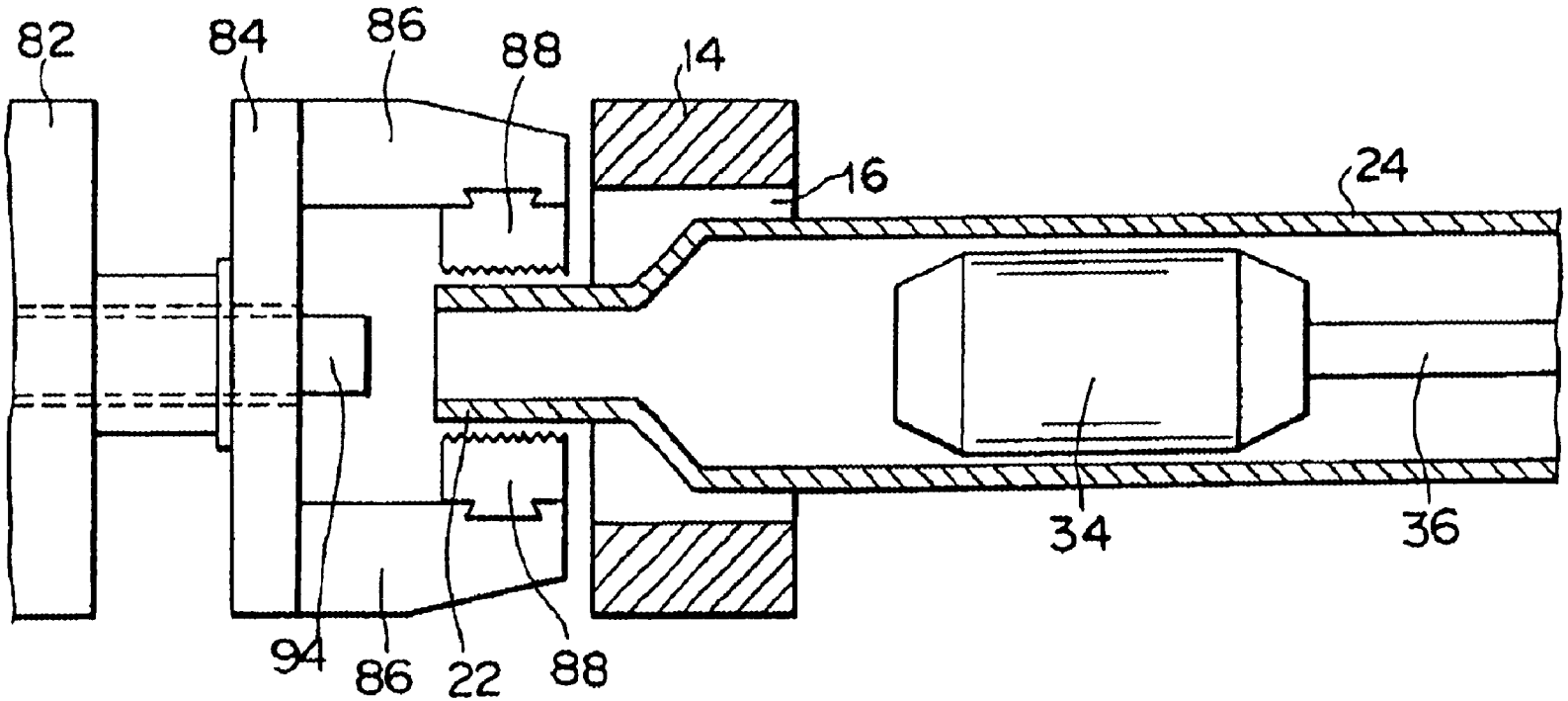
FIG. 10 is a partial sectional view showing a part of the elongated stock member positioned in an elongated stock passage space formed in the die holding member.
Figure 11:
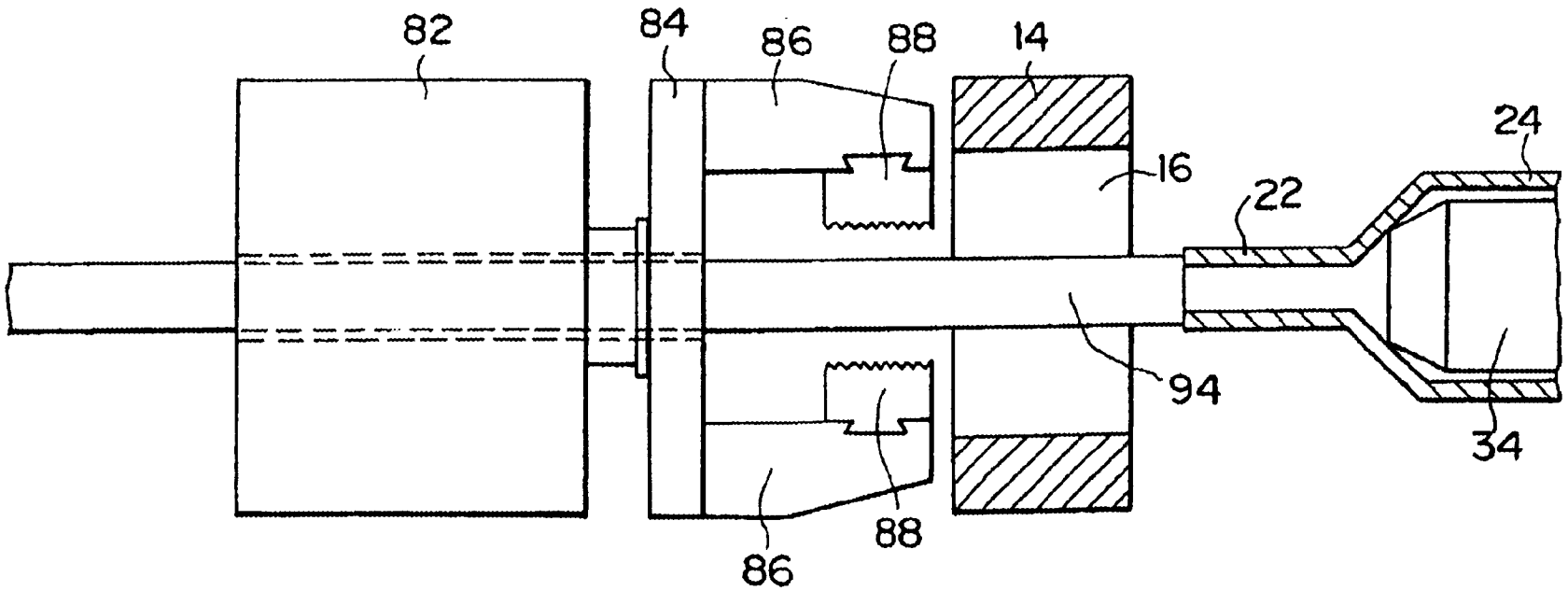
FIG. 11 is a partial sectional view showing the state in which the elongated stock has passed through the elongated stock passage in the die holding member.

Thereafter, when the chucking cylinder 82 operates to move the actuating member 84 and the pair of arms 86 toward the chucking cylinder 82, the pair of chucks 88 move away from the flat portion 22 of the elongated stock 20, so that the elongated stock is released from the chucks 88 (FIG. 10). In this state, the elongated stock 20 is held by the plug 34 fixed to the front end of the rod 36. Thereafter, the pushing/moving cylinder 96 is actuated to extend the actuating rod 94. With extension of the actuating rod 94, the front end of the actuating rod comes into contact with a front end of the flat portion 22 of the elongated stock 20. Then, the actuating rod 94 pushes the flat portion 22 of the elongated stock 20 until the flat portion 22 has passed through the elongated stock passage 16 formed in the die holding member 14. Consequently, the elongated stock 20 can pass through the space 16 (FIG. 11). Subsequently, the pushing/moving cylinder 96 is operated to move the actuating rod 94 back to its original state. Then, the reciprocating member 80 is moved toward the side opposite to the dies holding member 14.

Thus, when the elongated stock 20 is allowed to pass completely through the elongated stock passage 16 in the die holding member 14, the elongated stock 20 is pushed using the pushing/moving cylinder 96 and the actuating rod 94, thus eliminating the need for contacting the rollers 44 with the surface of the elongated stock 20. Consequently, slippage does not occur during movement of the elongated stock 20 and it is not required to adjust the distance between rollers 44 for each of different diameters of elongated stocks 20, thus making it possible to prevent damage to the surface of the elongated stock 20.

Figure 12:
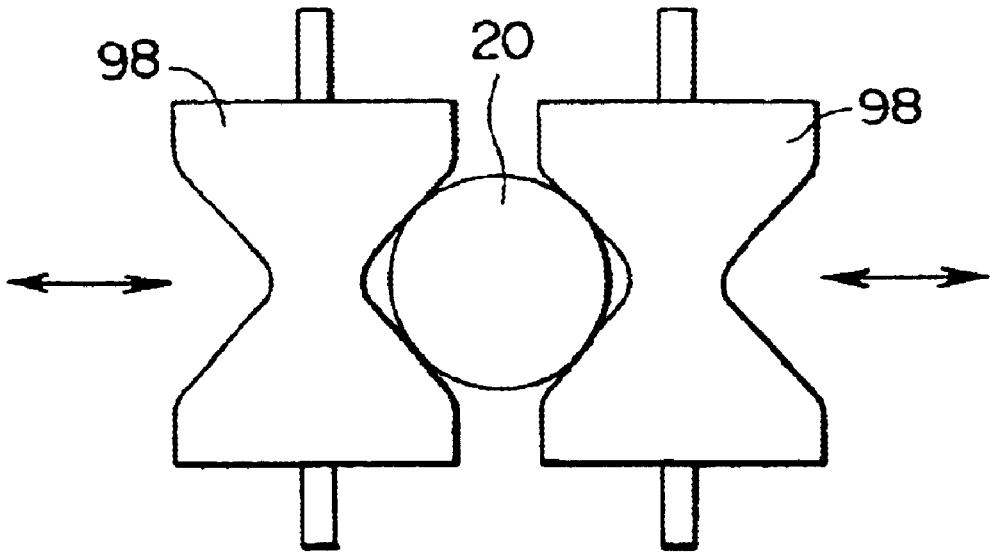
FIG. 12 is a diagram showing a state in which the elongated stock member is held by holding rollers.
Figure 13:
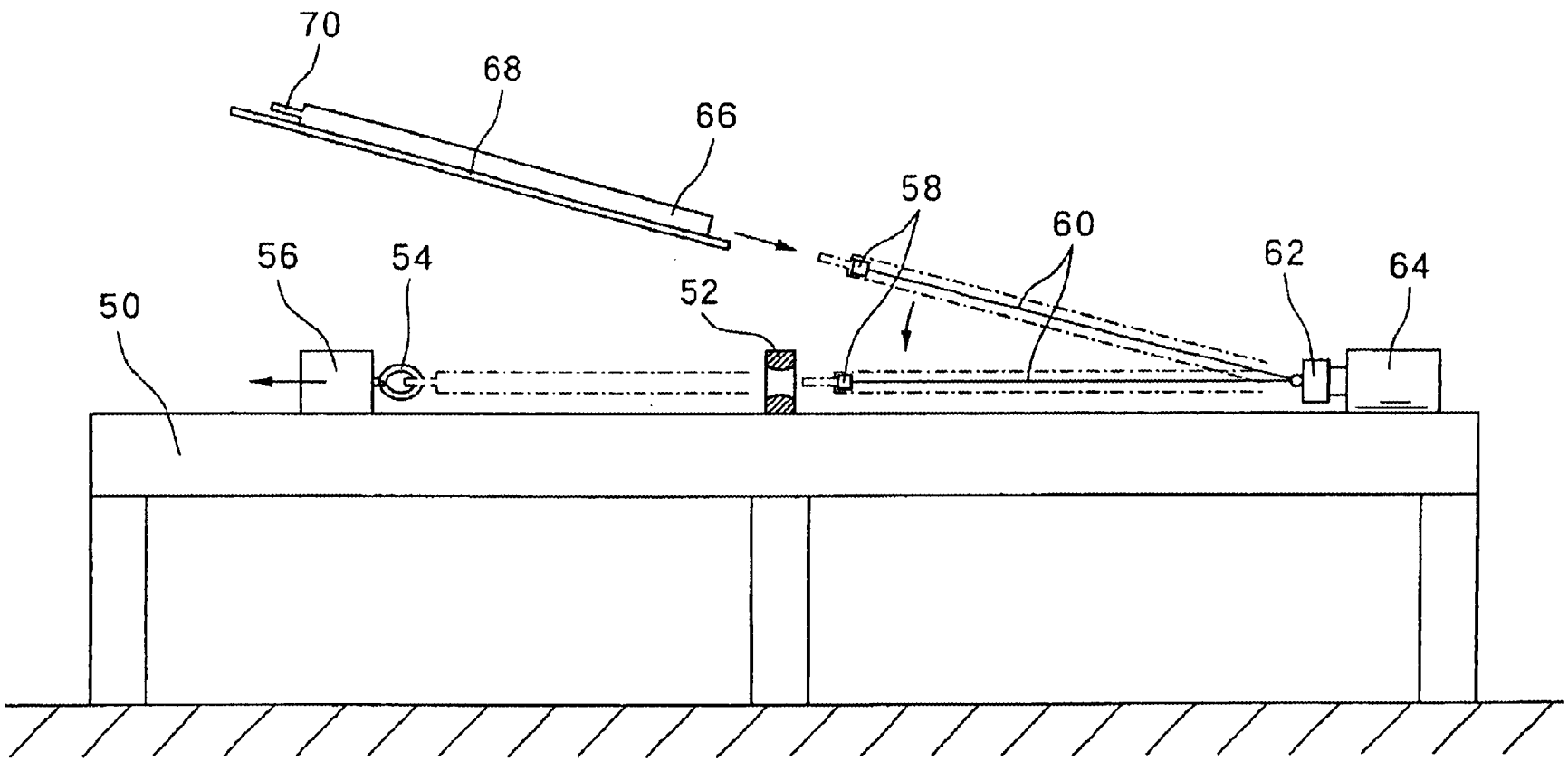
FIG.13 (PRIOR ART)
FIG. 13 is a front view of a conventional elongated stock drawing apparatus.
Figure 14:
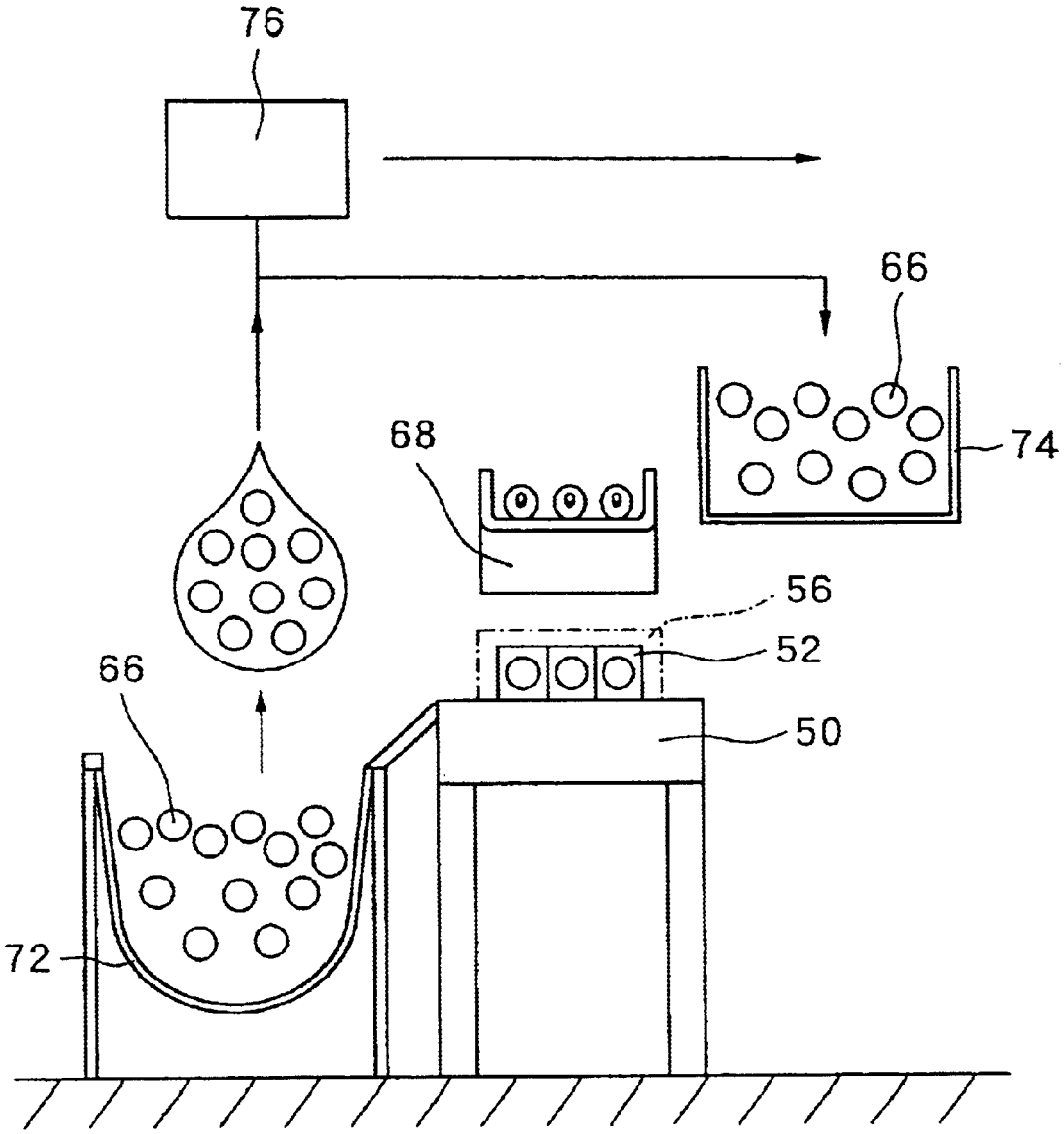
FIG.14 (PRIOR ART)
FIG. 14 is a side view thereof.
Figure 15:
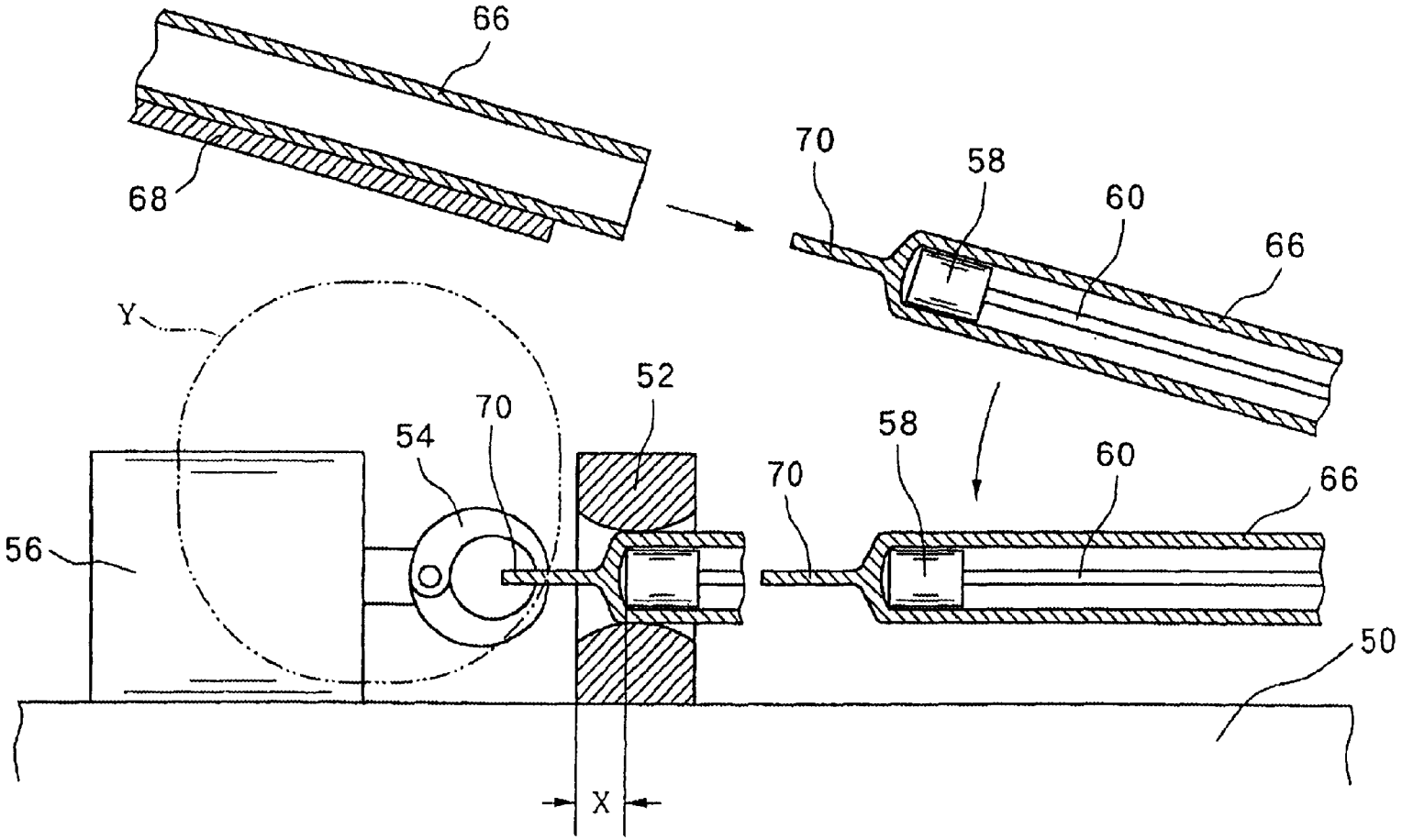
FIG. 15 (PRIOR ART)
FIG. 15 is a sectional view of a principal portion of the apparatus shown in FIG. 13.

For preventing damage to the stock surface, such holding rollers 98 as shown in FIG. 12 may be used instead of the holding members 40 used in FIGS. 1 and 3 to hold the elongated stock 20 from below. Although the holding members 40 support the elongated stock 20 from below, the holding rollers 98 support the elongated stock from both right and left sides and, as the elongated stock moves, the holding rollers 98 rotate by virtue of a friction induced by contact thereof with the elongated stock. By forming the contact surface of each holding roller 98 which comes into contact with the elongated stock 20 using a material which does not damage the elongated stock, it is possible to prevent the stock surface from being damaged.

As set forth above, according to the continuous elongated stock drawing method and apparatus of the invention, plural types of drawings can be effected by a single apparatus with a series of automated steps. Further, it is possible to omit the work of plug and die replacement for each type of drawing as in the prior art and thereby shorten the time required for the drawing.

In the apparatus of the present invention, moreover, since an elongated stock is reciprocated within the same location for plural stages of drawings, the area occupied by the apparatus can be made narrower than in the prior art wherein an elongated stock is moved sideways at every stage of drawing.

In the present invention, since no obstacle is presented to visual check of the die-plug distance X, it is possible to visually check the distance X easily. Consequently, it becomes possible to adjust the distance X visually and hence possible to draw the elongated stock with a higher accuracy.

When an elongated stock is to be passed through the elongated stock passage formed in the dies holding member, the passage of the elongated stock can be ensured without any fear of slippage, by pushing the front end of the flat portion of the elongated stock with use of the pushing/moving means, thus making it possible to eliminate the need of adjusting the roller-to-roller distance in the case of using rollers and hence possible to prevent damage to the surface of the elongated stock.

What is claimed is:

1. An apparatus for continuously drawing an elongated stock in the form of a hollow cylinder having an open end and an opposing end, said apparatus comprising:

a base;

a die holding member mounted on said base at a position intermediate opposing ends of said base, said die holding member presenting, in a first vertical position, at least one die for drawing the elongated stock to a first diameter, and defining a second vertical position allowing the open end of the elongated stock to pass through said intermediate position, by-passing the dies;

at least one chuck for chucking an end of the elongated stock opposite the open end, said chuck comprising a plurality of jaws arranged around a central axis of the chuck and a pusher movable axially, relative to said jaws, along the central axis;

at least one chuck actuator for moving said jaws to a closed position grasping the opposing end of the elongated stock and to an open position where the opposing end of the elongated stock is released;

at least one pusher actuator for, with said one chuck in a limit extended position and said jaws in said open position, moving the pusher axially toward said die holding member to further move the elongated stock and to cause the open end to pass through said intermediate position;

first horizontal moving means for moving said chuck means horizontally relative to said base, toward said die holding member to the limit extended position and away from said die holding member to a retracted position, said first horizontal moving means being mounted on said base, on one side of the die holding member;

at least one insert rod to be fitted in the elongated stock, said rod being provided on the side of the die holding member opposite said first horizontal moving means; and second horizontal moving means for moving said insert rod toward said first horizontal moving means, for insertion of said insert rod into the open end of the elongated stock and for moving the elongated stock, mounted on said insert rod, toward said first horizontal moving means.

2. The apparatus of claim 1, further comprising retracting means, mounted on said base on the side of said die holding member opposite said first horizontal moving means, for moving the opposing end of the elongated stock away from the die holding member.

3. The apparatus of claim 1, wherein said chuck, said pusher, said chuck actuator, and said pusher actuator are mounted on said first moving means for horizontal movement therewith.

4. The apparatus of claim 1, wherein said pusher is a pusher rod, wherein said pusher actuator includes a pushing/moving cylinder, wherein said chuck actuator includes a chucking cylinder and a cylindrical actuating member, and wherein said chucking cylinder and said cylindrical actuating member have central openings through which said pusher rod extends.

5. The apparatus of claim 1, further comprising vertical moving means on which a plurality of vertically spaced second horizontal moving means are mounted for movement perpendicular to said base, said plural second horizontal moving means respectively carrying different insert rods for respectively mating with elongated stock members of different diameters.

6. The apparatus of claim 1 wherein said die holding member is linearly movable, perpendicular to said base, and wherein said first and second vertical positions are aligned with each other and with the base and are vertically spaced.

7. The apparatus of claim 2 wherein said die holding member is linearly movable, perpendicular to said base, and wherein said first and second vertical positions are aligned with the base and are vertically spaced.

8. The apparatus of claim 3 wherein said die holding member is linearly movable, perpendicular to said base, and wherein said first and second vertical positions are aligned with the base and are vertically spaced.

9. The apparatus of claim 4 wherein said die holding member is linearly movable, perpendicular to said base, and wherein said first and second vertical positions are aligned with the base and are vertically spaced.

10. The apparatus of claim 5 wherein said die holding member is linearly movable, perpendicular to said base, and wherein said first and second vertical positions are aligned with the base and are vertically spaced.

11. The apparatus of claim 1 wherein said die holding member presents, in a third vertical position, at least one die for drawing the elongated stock to a second diameter, smaller than the first diameter.

12. The apparatus of claim 6 wherein said die holding member presents, in a third vertical position, at least one die for drawing the elongated stock to a second diameter, smaller than the first diameter.

* * * * *